US011401936B2

(12) United States Patent
Shinoda et al.

(10) Patent No.: US 11,401,936 B2
(45) Date of Patent: Aug. 2, 2022

(54) MOTOR-DRIVEN ROOTS PUMP WITH SMOOTH ACTIVATION IN LOW-TEMPERATURE ENVIRONMENT

(71) Applicant: KABUSHIKI KAISHA TOYOTA JIDOSHOKKI, Aichi-ken (JP)

(72) Inventors: Fumiya Shinoda, Kariya (JP); Daisuke Masaki, Kariya (JP); Takayuki Hirano, Kariya (JP); Shintaro Kashiwa, Kariya (JP); Naoki Takani, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 145 days.

(21) Appl. No.: 16/930,920

(22) Filed: Jul. 16, 2020

(65) Prior Publication Data

US 2021/0025388 A1 Jan. 28, 2021

(30) Foreign Application Priority Data

Jul. 24, 2019 (JP) ..... JP2019-136205

(51) Int. Cl.
*F04C 18/12* (2006.01)
*F04C 18/16* (2006.01)
(Continued)

(52) U.S. Cl.
CPC ..... *F04C 18/126* (2013.01); *F04C 18/082* (2013.01); *F04C 29/0085* (2013.01);
(Continued)

(58) Field of Classification Search
CPC ..... F04C 18/12; F04C 18/62; F04C 18/16; F04C 18/08; F04C 18/082; F04C 2/126; F04C 15/16; F04C 15/0038
See application file for complete search history.

(56) References Cited

U.S. PATENT DOCUMENTS 3,275,225 A * 9/1966 Schultz ..... F04C 18/126 418/150
7,320,579 B2 * 1/2008 Hirano ..... F04C 18/084 418/150

(Continued)

FOREIGN PATENT DOCUMENTS

JP 2006-283664 10/2006
JP 2014-148959 A 8/2014
JP 2017-133392 A 8/2017

*Primary Examiner* — Deming Wan
(74) *Attorney, Agent, or Firm* — Greenblum & Bernstein, P.L.C.

(57) ABSTRACT

A motor-driven Roots pump includes a housing, a drive shaft and a driven shaft that have axial lines parallel with each other, and a gear chamber. The housing includes a first partition that has a first defining surface, a second partition having a second defining surface, and a relief recess. An addendum circle of the drive gear and an addendum circle of the driven gear intersect with each other at a first intersection point. A plane that includes both the axial lines is defined as an imaginary plane. The first intersection point is located on a side of the imaginary plane on which the drive gear and the driven gear start meshing with each other. An opening of the relief recess is opposed to the first intersection point and is arranged in a region on a side of the imaginary plane on which the first intersection point is located.

4 Claims, 5 Drawing Sheets

(51) Int. Cl.

| | |
|---|---|
| ***F04C 18/08*** | (2006.01) |
| ***F04C 2/12*** | (2006.01) |
| ***F04C 15/00*** | (2006.01) |
| ***F04C 29/00*** | (2006.01) |

(52) U.S. Cl.
CPC .. *F04C 2210/1055* (2013.01); *F04C 2240/20* (2013.01); *F04C 2240/30* (2013.01); *F04C 2240/40* (2013.01); *F04C 2240/60* (2013.01)

(56) References Cited

U.S. PATENT DOCUMENTS

| | | | | |
|---|---|---|---|---|
| 8,784,087 | B2 * | 7/2014 | Hirano | F04C 18/126 418/206.5 |
| 2006/0140805 | A1 * | 6/2006 | Yamane | F04C 15/0088 418/55.3 |
| 2008/0107552 | A1 * | 5/2008 | Fujii | F04C 2/126 417/423.12 |
| 2015/0071765 | A1 * | 3/2015 | Trudeau | F02B 33/36 415/124.1 |

* cited by examiner

MOTOR-DRIVEN ROOTS PUMP WITH SMOOTH ACTIVATION IN LOW-TEMPERATURE ENVIRONMENT

BACKGROUND

1. Field

The present disclosure relates to a motor-driven Roots pump.

2. Description of Related Art

A typical motor-driven Roots pump includes a housing that rotationally supports a drive shaft and a driven shaft. The driven shaft is arranged to be parallel with the drive shaft. When an electric motor operates, the drive shaft rotates. A drive gear is fixed to the drive shaft. A driven gear, which meshes with the drive gear, is fixed to the driven shaft. The drive shaft is provided with a drive rotor. The driven shaft is provided with a driven rotor, which meshes with the drive rotor. When the drive shaft rotates, the driven shaft rotates in a direction opposite to the rotating direction of the drive shaft through the drive gear and the driven gear, which mesh with each other. Accordingly, the drive rotor and the driven rotor, which mesh with each other, rotate in opposite directions. The motor-driven Roots pump draws in and discharges fluid through rotations of the drive rotor and the driven rotor.

For example, Japanese Laid-Open Patent Publication No. 2006-283664 discloses a typical Roots pump that includes a housing. The housing has a motor chamber, which accommodates an electric motor, a gear chamber, which accommodates a drive gear and a driven gear, and a rotor chamber, which accommodates a drive rotor and a driven rotor. The motor chamber, the gear chamber, and the rotor chamber are arranged in order along an axial line of a drive shaft. The housing includes a first partition, which separates the gear chamber and the motor chamber from each other in the axial direction of the drive shaft, and a second partition, which separates the gear chamber and the rotor chamber from each other in the axial direction of the drive shaft. Oil that lubricates the drive gear and the driven gear and limits temperature increase is sealed in the gear chamber. The drive gear and the driven gear rotate while being put in the oil so as to be allowed to rotate at high speed without seizing or wearing.

Under a low-temperature environment, for example, when the outside temperature is below zero Celsius, the temperature of the oil sealed in the gear chamber drops. When the motor-driven Roots pump is activated in such a state, the drive gear and the driven gear rotate while scooping high-viscosity oil. The high-viscosity oil caught between the drive gear and the driven gear acts as resistance to rotations of the drive gear and the driven gear. This hinders smooth rotations of the drive gear and the driven gear. On the other hand, if the amount of oil caught between the drive gear and the driven gear is excessively reduced, the drive gear and the driven gear are more susceptible to seizure and wear. This reduces the durability of the drive gear and the driven gear.

SUMMARY

It is an objective of the present disclosure to provide a motor-driven Roots pump that is capable of smoothly rotating a drive gear and a driven shaft when activated under a low-temperature environment, while maintaining the durability of the drive gear and the driven gear.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a motor-driven Roots pump that includes a housing, and a drive shaft and a driven shaft that are rotationally supported by the housing is provided. The drive shaft and the driven shaft have axial lines that are parallel with each other. The motor-driven Roots pump further includes a drive gear that is fixed to the drive shaft, a driven gear that is fixed to the driven shaft and meshes with the drive gear, a drive rotor that is provided on the drive shaft, a driven rotor that is provided on the driven shaft and meshes with the drive rotor, an electric motor that is configured to rotate the drive shaft, a motor chamber that is defined in the housing and accommodates the electric motor, a gear chamber, and a rotor chamber. The gear chamber is defined in the housing and accommodates the drive gear and the driven gear. Oil is sealed in the gear chamber. The rotor chamber is defined in the housing and accommodates the drive rotor and the driven rotor. The motor chamber, the gear chamber, and the rotor chamber are arranged in order along the axial line. The housing includes a first partition, a second partition, and a relief recess. The first partition separates the gear chamber and the motor chamber from each other in an axial direction of the drive shaft and includes a first defining surface that defines the gear chamber. The second partition separates the gear chamber and the rotor chamber from each other in the axial direction and includes a second defining surface that defines the gear chamber. The relief recess opens in at least one of the first defining surface and the second defining surface. When viewed in the axial direction, an addendum circle of the drive gear and an addendum circle of the driven gear intersect with each other at a first intersection point and a second intersection point. A plane that includes both of the axial line of the drive shaft and the axial line of the driven shaft is defined as an imaginary plane. The first intersection point is located on a side of the imaginary plane on which the drive gear and the driven gear start meshing with each other. The second intersection point is located on a side of the imaginary plane on which the drive gear and the driven gear finish meshing with each other. An opening of the relief recess is opposed to the first intersection point and is arranged in a region on a side of the imaginary plane on which the first intersection point is located.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A motor-driven Roots pump 10 according to an embodiment will now be described with reference to FIGS. 1 to 9. The motor-driven Roots pump 10 of the present embodiment is used as a fuel cell hydrogen pump for supplying hydrogen to a fuel cell. A fuel cell generates power through a chemical reaction between fuel gas and oxidant gas. One example of fuel gas is hydrogen, and one example of oxidant gas is oxygen contained in the air.

Figure 1:
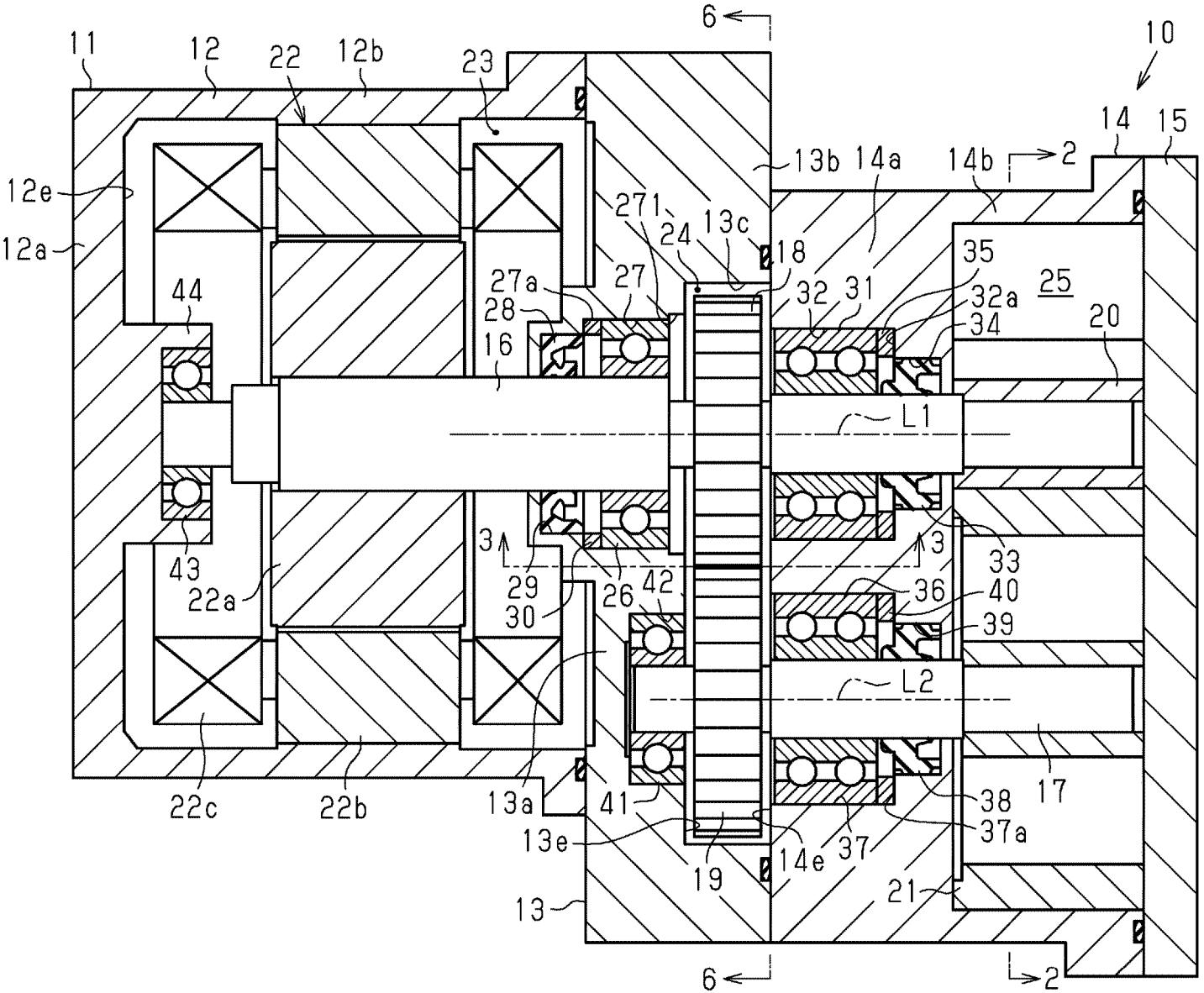
FIG. 1 is a cross-sectional plan view illustrating a motor-driven Roots pump according to an embodiment.

As shown in FIG. 1, the motor-driven Roots pump 10 includes a cylindrical housing 11. The housing 11 includes a motor housing member 12, a gear housing member 13, a rotor housing member 14, and a plate-shaped cover member 15. The motor housing member 12 includes a circumferential wall 12*b* and an end wall 12*a* that closes a first end (the left end as viewed in FIG. 1) of the circumferential wall 12*b*. The circumferential wall 12*b* also has a second end, which is an open end. The gear housing member 13 includes a circumferential wall 13*b* and an end wall 13*a* that closes a first end (the left end as viewed in FIG. 1) of the circumferential wall 13*b*. The circumferential wall 13*b* also has a second end, which is an open end. The gear housing member 13 is coupled to the open end of the motor housing member 12. The end wall 13*a* of the gear housing member 13 closes the open end of the motor housing member 12.

The rotor housing member 14 includes a circumferential wall 14*b* and an end wall 14*a* that closes a first end (the left end as viewed in FIG. 1) of the circumferential wall 14*b*. The circumferential wall 14*b* also has a second end, which is an open end. The rotor housing member 14 is coupled to the open end of the gear housing member 13. The end wall 14*a* of the rotor housing member 14 closes the open end of the gear housing member 13. The cover member 15 is coupled to the open end of the rotor housing member 14 to be opposed to the end wall 14*a*, thereby closing the second end of the circumferential wall 14*b*. The directions in which the axes of the circumferential walls 12*b*, 13*b*, 14*b* extend coincide with each other.

The motor-driven Roots pump 10 includes a drive shaft 16 and a driven shaft 17. The drive shaft 16 and the driven shaft 17 are rotationally supported by the housing 11. An axial line L1 of the drive shaft 16 is parallel with an axial line L2 of the driven shaft 17. The directions in which the axial lines L1, L2 and the axes of the circumferential walls 12*b*, 13*b*, 14*b* extend coincide with each other. Hereinafter, the direction in which the axial lines L1, L2 extend will be referred to as an axial direction. A disk-shaped drive gear 18 is fixed to the drive shaft 16. A disk-shaped driven gear 19, which meshes with the drive gear 18, is fixed to the driven shaft 17. The drive shaft 16 is provided with a drive rotor 20. The driven shaft 17 is provided with a driven rotor 21, which meshes with the drive rotor 20.

The motor-driven Roots pump 10 includes an electric motor 22, which rotates the drive shaft 16. The electric motor 22 is accommodated in a motor chamber 23 defined in the housing 11. The motor chamber 23 is defined by the end walls 12*a*, 13*a* and the circumferential wall 12*b*. The electric motor 22 includes a cylindrical motor rotor 22*a* and a cylindrical stator 22*b*, which is fixed to the inner circumferential surface of the circumferential wall 12*b*. The motor rotor 22*a* is secured to the drive shaft 16 so as to rotate integrally with the drive shaft 16. The stator 22*b* surrounds the outer circumference of the motor rotor 22*a*. The stator 22*b* includes a coil 22*c*, which is wound about teeth (not shown). When power is supplied to the coil 22*c*, the electric motor 22 is activated so that the motor rotor 22*a* rotates integrally with the drive shaft 16.

A gear chamber 24 is defined in the housing 11. The gear chamber 24 accommodates the drive gear 18 and the driven gear 19. The gear chamber 24 is defined by the end walls 13*a*, 14*a* and the circumferential wall 13*b*. The drive gear 18 and the driven gear 19 are accommodated in the gear chamber 24 while meshing with each other. Oil is sealed in the gear chamber 24. The oil contributes to lubrication of the drive gear 18 and the driven gear 19 and suppression of temperature increase. The drive gear 18 and the driven gear 19 rotate while being put in the oil so as to be allowed to rotate at high speeds without seizing or wearing.

A rotor chamber 25 is defined in the housing 11. The rotor chamber 25 accommodates the drive rotor 20 and the driven rotor 21. The rotor chamber 25 is defined by the end walls 14*a*, the circumferential wall 14*b*, and the cover member 15. The drive rotor 20 and the driven rotor 21 are accommodated in the rotor chamber 25 while meshing with each other. In the present embodiment, the motor chamber 23, the gear chamber 24, and the rotor chamber 25 are arranged in this order along the axial line L1.

The end wall 13*a* of the gear housing member 13 is a first partition, which separates the gear chamber 24 and the motor chamber 23 from each other in the axial direction of the drive shaft 16. The end wall 14*a* of the rotor housing member 14 is a second partition, which separates the gear chamber 24 and the rotor chamber 25 from each other in the axial direction of the drive shaft 16.

The drive shaft 16 extends through the end walls 13*a*, 14*a*. The driven shaft 17 extends through the end wall 14*a*. The end wall 13*a* includes a first defining surface 13*e*, which defines the gear chamber 24. The end wall 14*a* includes a second defining surface 14*e*, which defines the gear chamber 24. The second defining surface 14*e* is an end face (the left end face as viewed in FIG. 1) of the end wall 14*a*. The first defining surface 13*e* and the second defining surface 14*e* are opposed to each other in the axial direction with the drive gear 18 and the driven gear 19 in between.

The end wall 13*a* includes a first bearing accommodation recess 27 and a first seal accommodation recess 29, which are arranged along the drive shaft 16. The first bearing accommodation recess 27 is located between the first seal accommodation recess 29 and the gear chamber 24. The recesses 27, 29 each include a circular open edge and an inner circumferential surface, which extends along the drive shaft 16. The first bearing accommodation recess 27 accommodates a first bearing 26, which rotationally supports the drive shaft 16. The end wall 13*a* has a circular hole 271, which extends through the end wall 13*a* between the first bearing accommodation recess 27 and the first defining surface 13*e*. Accordingly, the open edge of the first bearing accommodation recess 27 is separated from the first defining surface 13*e* by a distance corresponding to the length along the axial line of the circular hole 271. The diameter of the circular hole 271 is slightly larger than the diameter of the opening of the first bearing accommodation recess 27. The first bearing 26 accommodated in the first bearing accommodation recess 27 is separated from the first defining surface 13*e* by a distance corresponding to the length along the axial line of the circular hole 271.

The drive shaft 16 extends through the circular hole 271, the first bearing accommodation recess 27, and the first seal accommodation recess 29. The first bearing accommodation recess 27 includes an annular first stepped surface 27*a*, which extends toward the drive shaft 16 from the inner circumferential surface. The first seal accommodation recess 29 opens in the first stepped surface 27*a*. The first seal accommodation recess 29 accommodates an annular first seal member 28, which seals the gear chamber 24 and the motor chamber 23 from each other. The internal space of the first seal accommodation recess 29 is continuous with the internal space of the first bearing accommodation recess 27. An annular first spacer 30 is arranged along the drive shaft 16 and between the first bearing 26 and the first stepped surface 27*a*.

The end wall 14*a* includes a second bearing accommodation recess 32 and a second seal accommodation recess 34, which are arranged along the drive shaft 16. The second bearing accommodation recess 32 is located between the second seal accommodation recess 34 and the gear chamber 24. The recesses 32, 34 each include a circular open edge and an inner circumferential surface, which extends along the drive shaft 16. The second bearing accommodation recess 32 accommodates a second bearing 31, which rotationally supports the drive shaft 16. The second bearing accommodation recess 32 opens in the second defining surface 14*e*. The drive shaft 16 extends through the second bearing accommodation recess 32 and the second seal accommodation recess 34. The second bearing accommodation recess 32 includes an annular second stepped surface 32*a*, which extends toward the drive shaft 16 from the inner circumferential surface. The second seal accommodation recess 34 opens in the second stepped surface 32*a*. The second seal accommodation recess 34 accommodates an annular second seal member 33, which seals the gear chamber 24 and the rotor chamber 25 from each other. The internal space of the second seal accommodation recess 34 is continuous with the internal space of the second bearing accommodation recess 32. An annular second spacer 35 is arranged along the drive shaft 16 and between the second bearing 31 and the second stepped surface 32*a*.

The end wall 14*a* includes a third bearing accommodation recess 37 and a third seal accommodation recess 39, which are arranged along the driven shaft 17. The third bearing accommodation recess 37 is located between the third seal accommodation recess 39 and the gear chamber 24. The recesses 37, 39 each include a circular open edge and an inner circumferential surface. The inner circumferential surface extends along the driven shaft 17. The third bearing accommodation recess 37 opens in the second defining surface 14*e*. The third bearing accommodation recess 37 accommodates a third bearing 36, which rotationally supports the driven shaft 17. The driven shaft 17 extends through the third bearing accommodation recess 37 and the third seal accommodation recess 39. The third bearing accommodation recess 37 includes an annular third stepped surface 37*a*, which extends toward the driven shaft 17 from the inner circumferential surface. The third seal accommodation recess 39 opens in the third stepped surface 37*a*. The third seal accommodation recess 39 accommodates an annular third seal member 38, which seals the gear chamber 24 and the rotor chamber 25 from each other. The internal space of the third seal accommodation recess 39 is continuous with the internal space of the third bearing accommodation recess 37. An annular third spacer 40 is arranged along the driven shaft 17 and between the third bearing 36 and the third stepped surface 37*a*.

The end wall 13*a* includes a fourth bearing accommodation recess 42, which is aligned with the third bearing accommodation recess 37 along the driven shaft 17. The fourth bearing accommodation recess 42 includes a circular open edge and an inner circumferential surface, which extends along the driven shaft 17. The fourth bearing accommodation recess 42 opens in the first defining surface 13*e*. The fourth bearing accommodation recess 42 accommodates a fourth bearing 41. A first end (the left end as viewed in FIG. 1) of the driven shaft 17 is rotationally supported by the fourth bearing 41 in the fourth bearing accommodation recess 42. The driven shaft 17 has a second end, which is a free end. The second end of the driven shaft 17 is arranged inside the rotor chamber 25. The driven rotor 21 is attached to the second end of the driven shaft 17. The driven shaft 17 is thus supported in a cantilever-like manner by the housing 11.

A cylindrical bearing portion 44 protrudes along the drive shaft 16 from an inner surface 12*e* of the end wall 12*a*. The bearing portion 44 accommodates a fifth bearing 43. A first end (the left end as viewed in FIG. 1) of the drive shaft 16 is rotationally supported by the fifth bearing 43 in the bearing portion 44. The drive shaft 16 extends through the first seal accommodation recess 29, the first bearing accommodation recess 27, the gear chamber 24, the second bearing accommodation recess 32, and the second seal accommodation recess 34. The drive shaft 16 has a second end, which is a free end. The second end of the drive shaft 16 is arranged inside the rotor chamber 25. The drive rotor 20 is attached to the second end of the drive shaft 16. The drive shaft 16 is thus supported in a cantilever-like manner by the housing 11.

Figure 2:
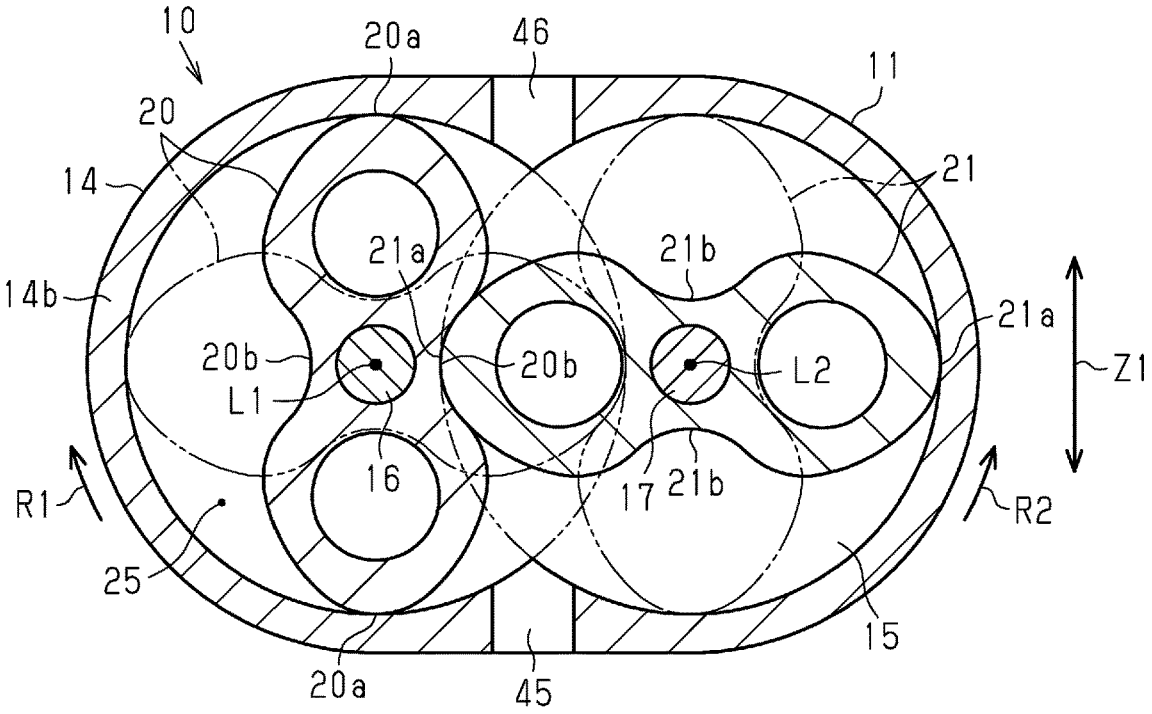
FIG. 2 is a cross-sectional view taken along line 2-2 of FIG. 1.

FIG. 2 shows a cross section that is orthogonal to both of the axial lines L1, L2. As shown in FIG. 2, the drive rotor 20 and the driven rotor 21 each have a two-lobe shaped cross section. The drive rotor 20 includes two lobes 20*a* and two recesses 20*b* disposed between the lobes 20*a*. The driven rotor 21 includes two lobes 21*a* and two recesses 21*b* disposed between the lobes 21*a*.

Meshing between the lobes 20*a* and the recesses 21*b* and meshing between the recesses 20*b* and the lobes 21*a* are repeated while the drive rotor 20 and the driven rotor 21 rotate in the rotor chamber 25. The drive rotor 20 rotates in a direction of arrow R1 in FIG. 2, and the driven rotor 21 rotates in a direction of arrow R2 in FIG. 2.

The circumferential wall 14*b* of the rotor housing member 14 has a suction port 45 and a discharge port 46. The suction port 45 and the discharge port 46 open at positions opposed to each other with the rotor chamber 25 in between. The rotor chamber 25 is continuous with the outside through the suction port 45 and the discharge port 46.

A direction in which the straight line passing through the suction port 45 and the discharge port 46 (hereinafter, referred to as a straight-line direction Z1) is orthogonal to the axial lines L1, L2. The motor-driven Roots pump 10 is installed such that the outward opening of the suction port 45 faces downward. Thus, when the motor-driven Roots pump 10 is in use, the straight-line direction Z1 matches the direction of gravity. In FIGS. 2 to 6, the upward arrow of the straight-line direction Z1 indicates an upward direction, and the downward arrow of the straight-line direction Z1 indicates a downward direction. The discharge port 46 is located above the axial lines L1, L2, and the suction port 45 is located below the axial lines L1, L2.

When the electric motor 22 operates, the drive shaft 16 rotates. Then, the driven shaft 17 rotates in a direction opposite to the rotating direction of the drive shaft 16 through the drive gear 18 and the driven gear 19, which mesh with each other. Accordingly, the drive rotor 20 and the driven rotor 21 rotate in opposite directions. The motor-driven Roots pump 10 draws fluid into the rotor chamber 25 through the suction port 45 and discharges the fluid in the rotor chamber 25 through discharge port 46 through rotations of the drive rotor 20 and the driven rotor 21.

Figure 3:
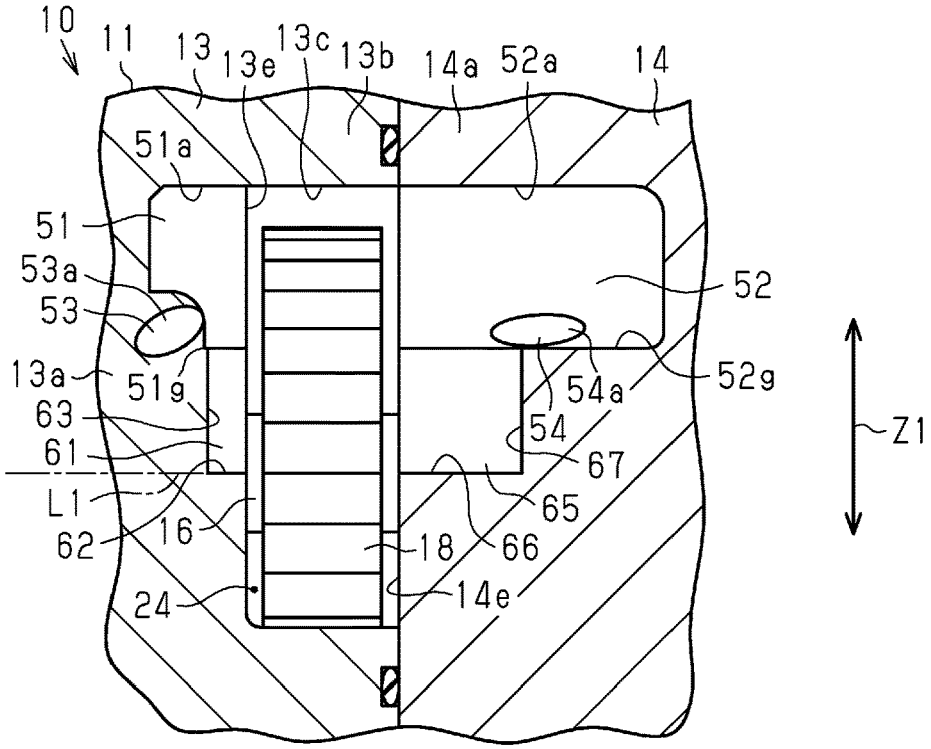
FIG. 3 is a cross-sectional view taken along line 3-3 of FIG. 1.

As shown in FIG. 3, the end wall 13*a* of the gear housing member 13 has a first recess 51, which opens in the first defining surface 13*e*. Also, the end wall 14*a* of the rotor housing member 14 has a second recess 52, which opens in the second defining surface 14*e*. The opening of the first recess 51 and the opening of the second recess 52 face each other in the axial direction.

Figure 4:
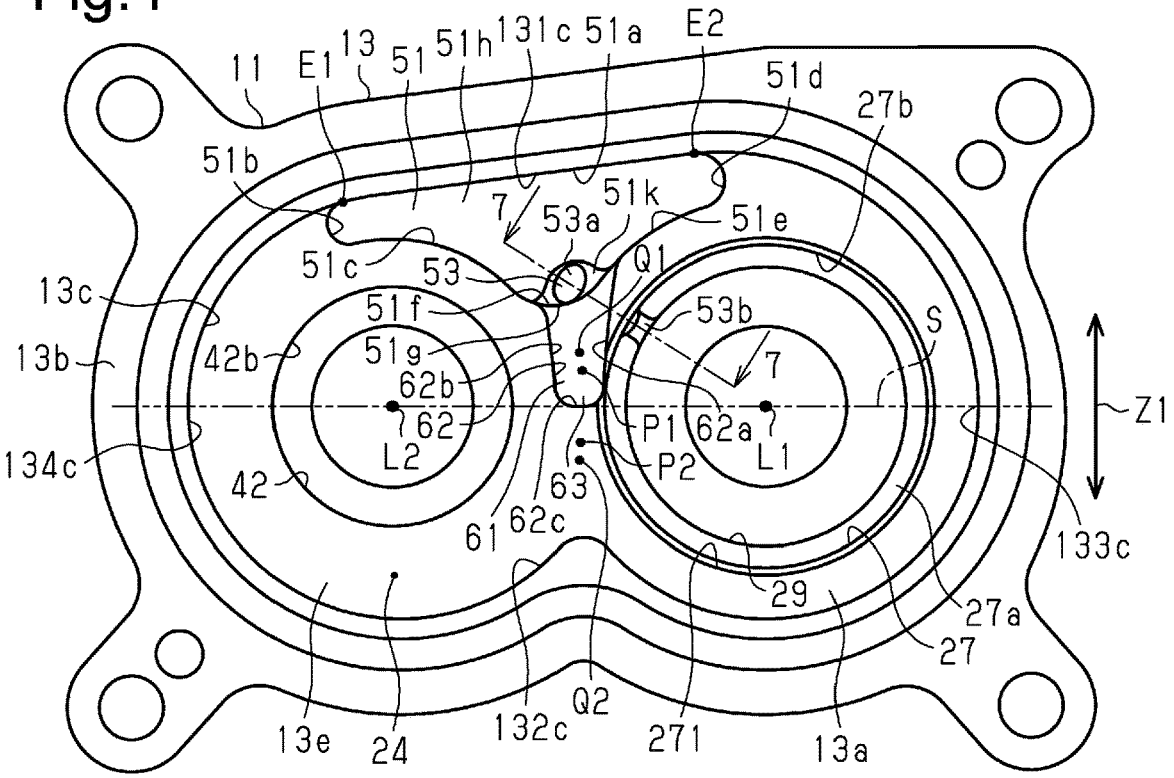
FIG. 4 is a front view a gear housing member of the motor-driven Roots pump of FIG. 1.

As shown in FIG. 4, the first recess 51 opens in the first defining surface 13*e* on the same side of an imaginary plane S, which includes the axial lines L1, L2, as the discharge port 46. The circumferential wall 13*b* of the gear housing member 13 has an inner circumferential surface 13*c*. The inner circumferential surface 13*c* includes a surface 131*c* that is closer to the discharge port 46 than the imaginary plane S, a surface 132*c* that is closer to the suction port 45 than the imaginary plane S, and connecting surfaces 133*c*, 134*c* that each have an arcuate cross-sectional shape. The connecting surface 134*c* extends between first edges (the left ends as viewed in FIG. 4) of the surfaces 131*c*, 132*c*, and the connecting surface 133*c* extends between second edges of the surfaces 131*c*, 132*c*. The inner circumferential surface 13*c* defines an inner circumferential surface of the gear chamber 24.

The first recess 51 has a first inner surface 51*a*, which is continuous with the surface 131*c*. The first inner surface 51*a* extends along the axial lines L1, L2. The first inner surface 51*a* extends along the surface 131*c* when the first recess 51 is viewed in the axial direction. When the first recess 51 is viewed in the axial direction, a first edge E1 of the first inner surface 51*a* is on the side of the fourth bearing accommodation recess 42 on which the discharge port 46 is located, and a second edge E2 of the first inner surface 51*a* is on the side of the first bearing accommodation recess 27 on which the discharge port 46 is located.

The first recess 51 has a second inner surface 51*b*, which is continuous with the first edge E1 of the first inner surface 51*a*. The second inner surface 51*b* extends in an arcuate cross-sectional shape toward the fourth bearing accommodation recess 42 from the first edge E1. When the first recess 51 is viewed in the axial direction, the second inner surface 51*b* is a curved surface that bulges away from the second edge E2 of the first inner surface 51*a* and toward the imaginary plane S.

The first recess 51 has a third inner surface 51*c*, which is continuous with a distal edge of the second inner surface 51*b* (the edge opposite from the first inner surface 51*a*). The third inner surface 51*c* extends toward the first bearing accommodation recess 27 from the second inner surface 51*b*. The third inner surface 51*c* is a curved surface that has an arcuate cross-sectional shape along an inner circumferential surface 42*b* of the fourth bearing accommodation recess 42.

The first recess 51 has a fourth inner surface 51*d*, which is continuous with the second edge E2 of the first inner surface 51*a*. The fourth inner surface 51*d* extends in an arcuate cross-sectional shape toward the first bearing accommodation recess 27 from the second edge E2. When the first recess 51 is viewed in the axial direction, the fourth inner surface 51*d* is a curved surface that bulges away from the first edge E1 of the first inner surface 51*a* and toward the imaginary plane S.

The first recess 51 has a fifth inner surface 51*e*, which is continuous with a distal edge of the fourth inner surface 51*d* (the edge opposite from the first inner surface 51*a*). The fifth inner surface 51*e* extends toward the fourth bearing accommodation recess 42 from the fourth inner surface 51*d*. The fifth inner surface 51*e* is a curved surface that has an arcuate cross-sectional shape along an inner circumferential surface 27*b* of the first bearing accommodation recess 27.

The first recess 51 has a sixth inner surface 51*f*, which extends between a distal edge of the third inner surface 51*c* (the edge opposite from the second inner surface 51*b*) and a distal edge of the fifth inner surface 51*e* (the edge opposite from the fourth inner surface 51*d*). The sixth inner surface 51*f* is a curved surface that bulges away from the first inner surface 51*a* and toward the imaginary plane S. The apex of the curve of the sixth inner surface 51*f* when the first recess 51 is viewed in the axial direction is a lowest section 51*g* of the first recess 51 in the direction of gravity.

Figure 5:
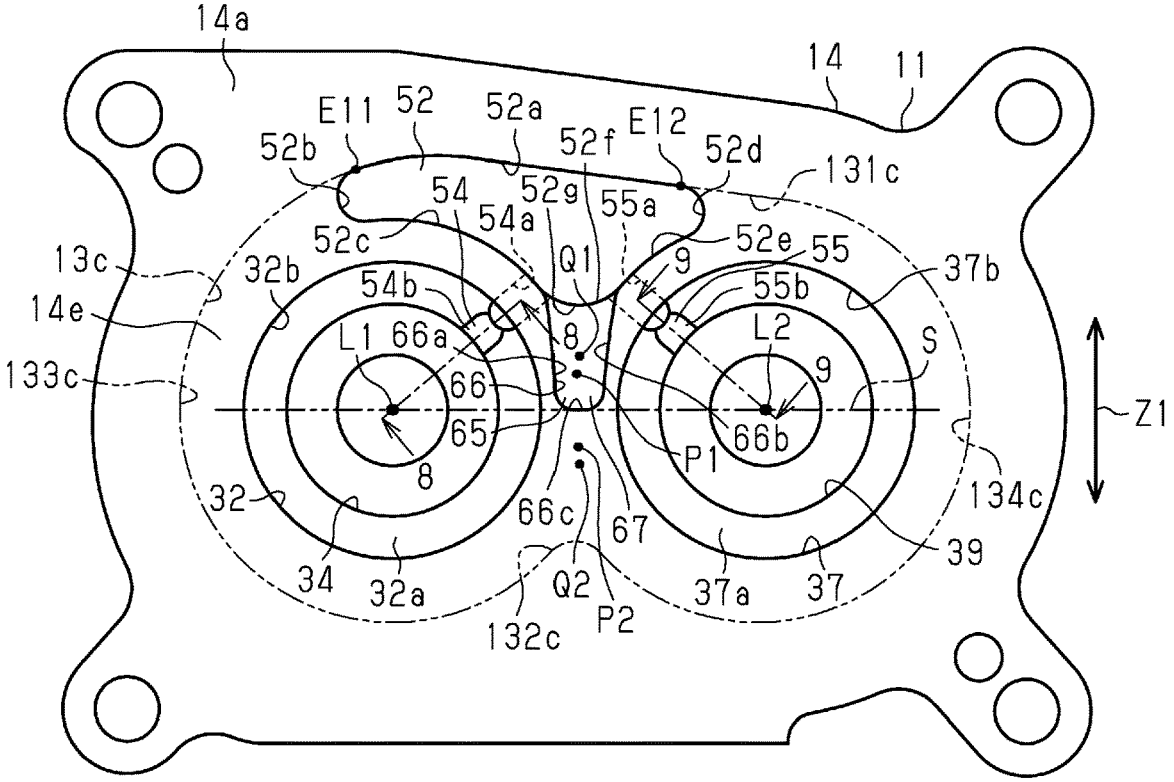
FIG. 5 is a front view a rotor housing member of the motor-driven Roots pump of FIG. 1.

As shown in FIG. 5, the second recess 52 opens in the second defining surface 14*e* on the side of the imaginary plane S on which the discharge port 46 is located.

The inner circumferential surface 13*c* (indicated by the long dashed double-short dashed line in FIG. 5) of the circumferential wall 13*b* includes the surface 131*c*, which is located on the side of the imaginary plane S on which the discharge port 46 is located. The second recess 52 includes a first inner surface 52*a*, which extends in the axial direction from the surface 131*c*. The first inner surface 52*a* extends along the surface 131*c* when the second recess 52 is viewed in the axial direction. When the second recess 52 is viewed in the axial direction, a first edge E11 of the first inner surface 52*a* is on the side of the second bearing accommodation recess 32 on which the discharge port 46 is located, and a second edge E12 of the first inner surface 52*a* is on the side of the third bearing accommodation recess 37 on which the discharge port 46 is located.

The second recess 52 includes a second inner surface 52*b*, which is continuous with the first edge E11 of the first inner surface 52*a*. The second inner surface 52*b* extends in an arcuate cross-sectional shape toward the second bearing accommodation recess 32 from the first edge E11. When the second recess 52 is viewed in the axial direction, the second inner surface 52*b* is a curved surface that bulges away from the second edge E12 of the first inner surface 52*a* and toward the imaginary plane S.

The second recess 52 has a third inner surface 52*c*, which extends toward the third bearing accommodation recess 37 from a distal edge of the second inner surface 52*b* (the edge opposite from the first inner surface 52*a*). The third inner surface 52*c* is a curved surface that has an arcuate cross-sectional shape along an inner circumferential surface 32*b* of the second bearing accommodation recess 32.

The second recess 52 includes a fourth inner surface 52*d*, which is continuous with the second edge E12 of the first inner surface 52*a*. The fourth inner surface 52*d* extends in an arcuate cross-sectional shape toward the third bearing accommodation recess 37 from the second edge E12. When the second recess 52 is viewed in the axial direction, the fourth inner surface 52*d* is a curved surface that bulges away from the first edge E11 of the first inner surface 52*a* and toward the imaginary plane S.

The second recess 52 has a fifth inner surface 52*e*, which extends toward the second bearing accommodation recess 32 from a distal edge of the fourth inner surface 52*d* (the edge opposite from the first inner surface 52*a*). The fifth inner surface 52*e* is a curved surface that has an arcuate cross-sectional shape along an inner circumferential surface 37*b* of the third bearing accommodation recess 37.

The second recess 52 has a sixth inner surface 52*f*, which extends between a distal edge of the third inner surface 52*c* (the edge opposite from the second inner surface 52*b*) and a distal edge of the fifth inner surface 52*e* (the edge opposite from the fourth inner surface 52*d*). The sixth inner surface 52*f* is a curved surface that bulges away from the first inner surface 52*a* and toward the imaginary plane S. The apex of the curve of the sixth inner surface 52*f* when the second recess 52 is viewed in the axial direction is a lowest section 52*g* of the second recess 52 in the direction of gravity.

Figure 6:
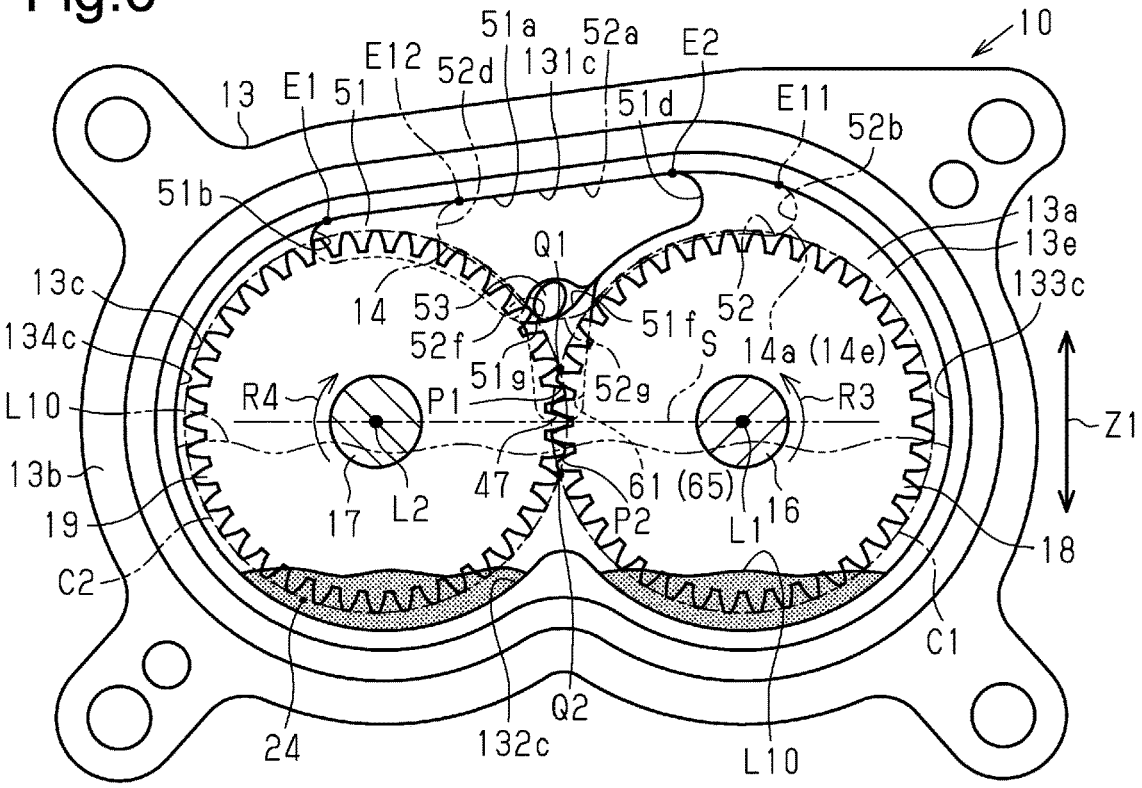
FIG. 6 is a cross-sectional view taken along line 6-6 of FIG. 1.

As shown in FIG. 6, the sixth inner surface 51*f* intersects with the sixth inner surface 52*f* when viewed in the axial direction. The lowest sections 51*g*, 52*g* are closest to the imaginary plane S in the first and second recesses 51, 52. The lowest sections 51*g*, 52*g* are located on the side of a meshing portion 47 of the drive gear 18 and the driven gear 19 on which the discharge port 46 is located.

When viewed in the axial direction, the second edge E12 of the first inner surface 52*a* is located between the first edge E1 and the second edge E2. When viewed in the axial direction, the second edge E2 of the first inner surface 51*a* is located between the first edge E12 and the second edge E12. Thus, the fourth inner surface 51*d* is located at a position closer to the meshing portion 47 than the second inner surface 52*b*, and the fourth inner surface 52*d* is located at a position closer to the meshing portion 47 than the second inner surface 51*b*.

At least a part of the opening of the first recess 51 is opposed to the opening of the second recess 52 with the region between the drive gear 18 and the driven gear 19 in between. The shortest distance from the first recess 51 to the imaginary plane S is equal to the shortest distance from the second recess 52 to the imaginary plane S.

In the present embodiment, the drive gear 18 rotates in the direction of arrow R3 in FIG. 6, and the driven gear 19 rotates in the direction of arrow R4 in FIG. 6. That is, when the electric motor 22 operates, the drive gear 18 and the driven gear 19 respectively rotate relative to the connecting surfaces 133*c*, 134*c* from the side on which the suction port 45 is located toward the side on which the discharge port 46 is located.

When rotating, the drive gear 18 and the driven gear 19 start meshing with each other at a first position P1 and finish meshing with each other at a second position P2. When viewed in the axial direction, the first position P1 in the meshing portion 47 is located on the side of the imaginary plane S on which the discharge port 46 is located. Accordingly, the first position P1 is located above the imaginary plane S.

When viewed in the axial direction, the second position P2 in the meshing portion 47 is located on the side of the imaginary plane S on which the suction port 45 is located. Accordingly, the second position P2 is located below the imaginary plane S.

The meshing portion 47 is a portion located between the first position P1 and the second position P2, where the tooth tips of the drive gear 18 and the tooth tips of the driven gear 19 overlap each other. The tooth tips of the drive gear 18 are located on an imaginary circle C1 the center of which coincides with the axial line L1. That is, the imaginary circle C1 is an addendum circle C1 of the drive gear 18, and the outer diameter of the drive gear 18 is equal to the diameter of the imaginary circle C1. The tooth tips of the driven gear 19 are located on an imaginary circle C2 the center of which coincides with the axial line L2. That is, the imaginary circle C2 is an addendum circle C2 of the driven gear 19, and the outer diameter of the driven gear 19 is equal to the diameter of the imaginary circle C2. When viewed in the axial direction, the addendum circles C1, C2 intersect with each other at a first intersection point Q1 and a second intersection point Q2. The first intersection point Q1 is located on the side of the imaginary plane S on which the first position P1 is located, and the second intersection point Q2 is located on the side of the imaginary plane S on which the second position P2 is located. That is, the first intersection point Q1 is located on the side of the imaginary plane S on which the gears 18, 19 start meshing with each other, and the second intersection point Q2 is located on the side of the imaginary plane S on which the gears 18, 19 finish meshing with each other.

Rotations of the drive gear 18 and the driven gear 19 scoop the oil sealed in the gear chamber 24 toward the discharge port 46 of the gear chamber 24 through the clearance between the drive gear 18 and the connecting surface 133*c* and the clearance between the driven gear 19 and the connecting surface 134*c*. Since the direction toward the discharge port 46 is the upward direction, the oil sealed in the gear chamber 24 is scooped against the direction of gravity. The oil scooped by the drive gear 18 and the oil scooped by the driven gear 19 collide with each other in the gear chamber 24 on the side of the meshing portion 47 on which the discharge port 46 is located, and flow into each of the first recess 51 and the second recess 52.

Figure 7:
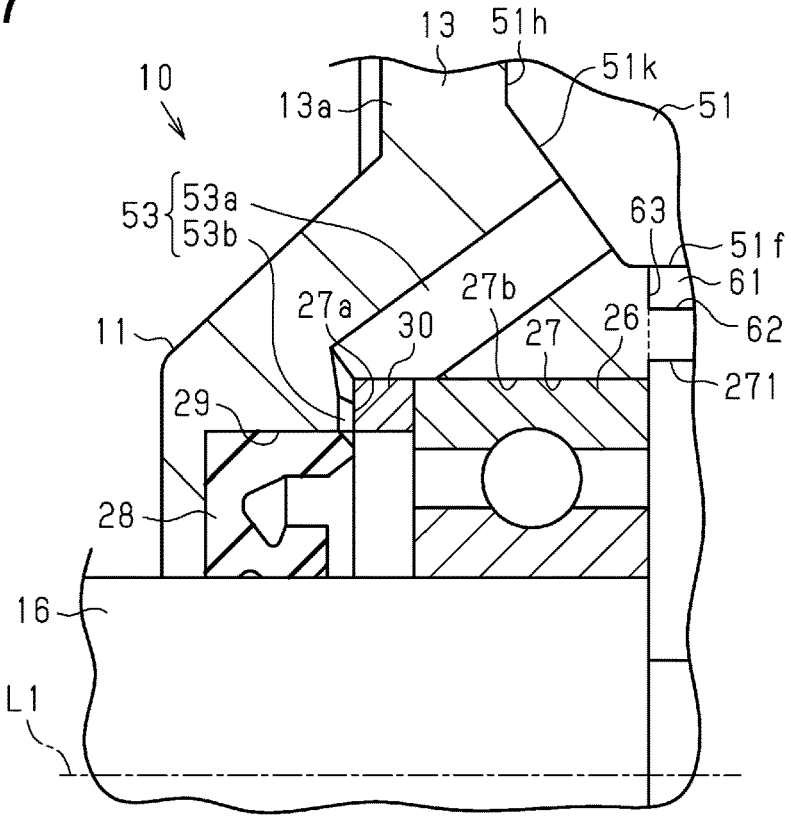
FIG. 7 is a cross-sectional view taken along line 7-7 of FIG. 4.

As shown in FIG. 7, the inner surface of the first recess 51 includes a surface 51*h* that faces the opening of the first recess 51 and a flat surface 51*k*. The flat surface 51*k* extends diagonally between the surface 51*h* and the sixth inner surface 51*f*. The end wall 13*a* includes a first oil supply passage 53, which supplies oil from the first recess 51 to the first seal accommodation recess 29. The first oil supply passage 53 includes a linearly extending first hole 53*a* and a first groove 53*b*. The first hole 53*a* includes a first end, which opens in the flat surface 51*k*, and a second end, which opens in the inner circumferential surface 27*b*. The second end of the first hole 53*a* opens at an end of the inner circumferential surface 27*b* that is in contact with the first stepped surface 27*a*. The second end of the first hole 53*a* overlaps with the outer circumferential surface of the first spacer 30 in the axial direction of the drive shaft 16. The first groove 53*b* is provided in the first stepped surface 27*a* of the first bearing accommodation recess 27, and has a first end, which is connected to the second end of the first hole 53*a*, and a second end, which is continuous with the internal space of the first seal accommodation recess 29. The oil in the first recess 51 is supplied to the first seal accommodation recess 29 through the first hole 53*a* and the first groove 53*b*. The diameter of the first hole 53*a* is reduced such that oil that has flowed into the first recess 51 is retained in the first recess 51.

Figure 8:
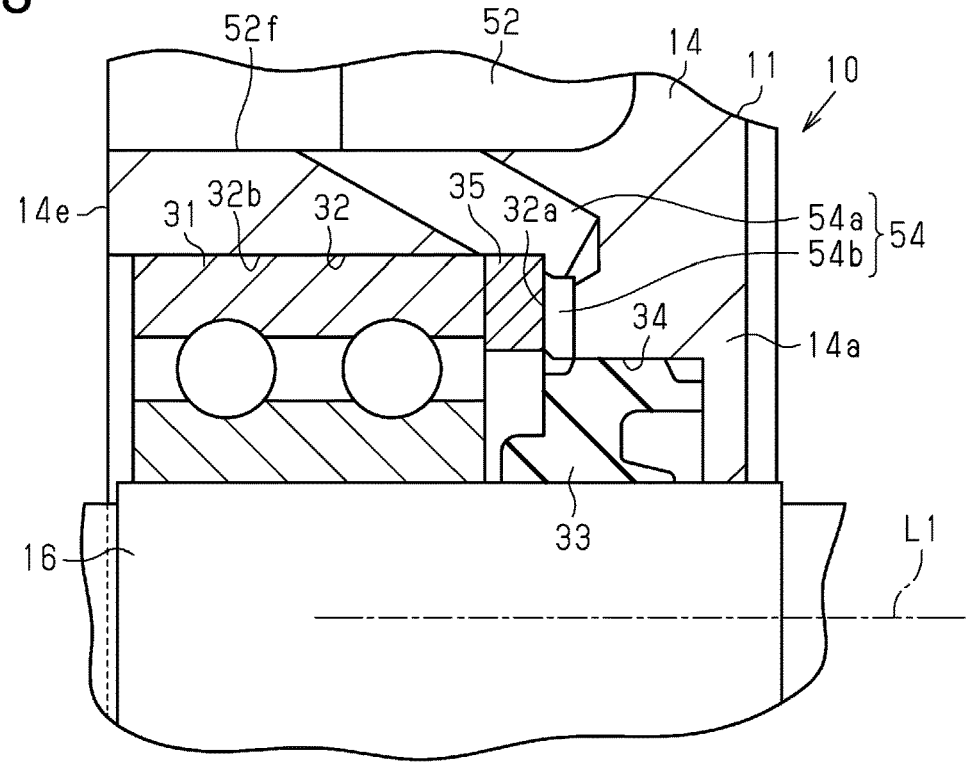
FIG. 8 is a cross-sectional view taken along line 8-8 of FIG. 5.

As shown in FIG. 8, the end wall 14*a* includes a second oil supply passage 54, which supplies oil from the second recess 52 to the second seal accommodation recess 34. The second oil supply passage 54 includes a linearly extending second hole 54*a* and a second groove 54*b*. The second hole 54*a* includes a first end, which opens in a section of the sixth inner surface 52*f* that is close to the third inner surface 52*c*, and a second end, which opens in a section of the inner circumferential surface 32*b* that is in contact with the second stepped surface 32*a*. The second end of the second hole 54*a* overlaps with the outer circumferential surface of the second spacer 35 in the axial direction of the drive shaft 16. The second groove 54*b* is provided in the second stepped surface 32*a* of the second bearing accommodation recess 32, and has a first end, which is connected to the second end of the second hole 54*a*, and a second end, which is continuous with the internal space of the second seal accommodation recess 34. The oil in the second recess 52 is supplied to the second seal accommodation recess 34 through the second hole 54*a* and the second groove 54*b*. The diameter of the second hole 54*a* is reduced such that oil that has flowed into the second recess 52 is retained in the second recess 52.

Figure 9:
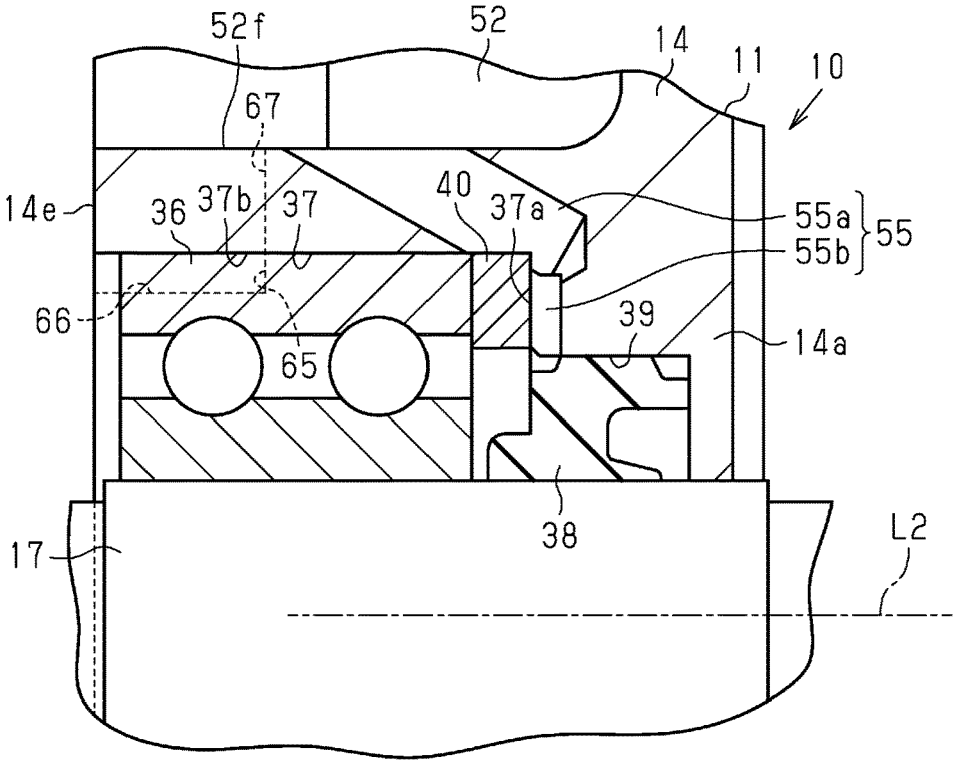
FIG. 9 is a cross-sectional view taken along line 9-9 of FIG. 5.

As shown in FIG. 9, the end wall 14*a* includes a third oil supply passage 55, which supplies oil from the second recess 52 to the third seal accommodation recess 39. The third oil supply passage 55 includes a linearly extending third hole 55*a* and a third groove 55*b*. The third hole 55*a* includes a first end, which opens in a section of the sixth inner surface 52*f* that is close to the fifth inner surface 52*e*, and a second end, which opens in a section of the inner circumferential surface 37*b* that is in contact with the third stepped surface 37*a*. The second end of the third hole 55*a* overlaps with the outer circumferential surface of the third spacer 40 in the axial direction of the driven shaft 17. The third groove 55*b* is provided in the third stepped surface 37*a* of the third bearing accommodation recess 37. The third groove 55*b* has a first end, which is connected to the second end of the third hole 55*a*, and a second end, which is continuous with the internal space of the third seal accommodation recess 39. The oil in the second recess 52 is supplied to the third seal accommodation recess 39 through the third hole 55*a* and the third groove 55*b*. The diameter of the third hole 55*a* is reduced such that oil that has flowed into the second recess 52 is retained in the second recess 52.

As shown in FIGS. 3 and 4, a first relief recess 61 opens in the first defining surface 13*e*. The first relief recess 61 has an open edge that is continuous with the first defining surface 13*e*. The first relief recess 61 includes a first extended surface 62, which extends along the axial lines L1, L2 from the open edge of the first relief recess 61, and a first upright surface 63, which extends in a direction orthogonal to the axial lines L1, L2 from the first extended surface 62. The first upright surface 63 extends upward from a distal edge of the first extended surface 62 (the edge opposite from the open edge of the first relief recess 61).

As shown in FIG. 4, the first extended surface 62 includes a first surface 62*a*, which extends toward the imaginary plane S from the fifth inner surface 52*e*. When viewed in the axial direction, the first surface 62*a* extends between the first intersection point Q1 and the first bearing accommodation recess 27. The first extended surface 62 includes a second surface 62*b*, which extends toward the imaginary plane S from the sixth inner surface 51*f*. When viewed in the axial direction, the second surface 62*b* extends between the first intersection point Q1 and the fourth bearing accommodation recess 42. The first extended surface 62 includes a third surface 62*c*, which connects the first surface 62*a* and the second surface 62*b* to each other. When viewed in the axial direction, the third surface 62*c* is a curved surface that is recessed to be separated away from the first recess 51. The internal space of the first relief recess 61 is continuous with the internal space of the first recess 51.

The third surface 62*c* is located closer to the imaginary plane S than the first intersection point Q1. When viewed in the axial direction, a section of the third surface 62*c* that is closest to the imaginary plane S is in contact with the imaginary plane S. Thus, when viewed in the axial direction, a section of the open edge of the first relief recess 61 that is closest to the imaginary plane S is in contact with the imaginary plane S. When viewed in the axial direction, the first extended surface 62 includes a section of the first relief recess 61 that is closest to the imaginary plane S. The first extended surface 62 is located on the side of the imaginary plane S on which the first intersection point Q1 is located.

The first upright surface 63 intersects with the first surface 62*a*, the second surface 62*b*, and the third surface 62*c* at the edge on the side opposite from the open edge of the first relief recess 61. The first upright surface 63 is continuous with most of the sixth inner surface 51*f* and a part of the fifth inner surface 51*e*. The first upright surface 63 is opposed to the first intersection point Q1. Thus, the opening of the first relief recess 61 is opposed to at least the first intersection point Q1 and is arranged in a region on the side of the imaginary plane S on which the first intersection point Q1 is located.

When viewed in the axial direction, a part of the first relief recess 61 overlaps with a part of the circular hole 271, and the internal space of the first relief recess 61 is continuous with the internal space of the circular hole 271. When viewed in the axial direction, a part of the first surface 62*a* overlaps with the inner circumferential surface 27*b* of the first bearing accommodation recess 27. When viewed in the axial direction, the entire second surface 62*b* is separated from the fourth bearing accommodation recess 42 and is located closer to the first intersection point Q1 than the fourth bearing accommodation recess 42. As shown in FIG. 7, the length in the axial direction of the first relief recess 61 is equal to the length in the axial direction of the circular hole 271.

As shown in FIGS. 3 and 5, a second relief recess 65 opens in the second defining surface 14*e*. The second relief recess 65 has an open edge that is continuous with the second defining surface 14*e*. The second relief recess 65 includes a second extended surface 66, which extends along the axial lines L1, L2 from the open edge of the second relief recess 65, and a second upright surface 67, which extends in a direction orthogonal to the axial lines L1, L2 from the second extended surface 66. The second upright surface 67 extends upward from a distal edge of the second extended surface 66 (the edge opposite from the open edge of the second relief recess 65).

As shown in FIG. 5, the second extended surface 66 includes a first surface 66*a*, which extends toward the imaginary plane S from a section of the sixth inner surface 52*f* that is closer to the third inner surface 52*c*. When viewed in the axial direction, the first surface 66*a* extends between the first intersection point Q1 and the second bearing accommodation recess 32. The second extended surface 66 includes a second surface 66*b*, which extends toward the imaginary plane S from a section of the sixth inner surface 52*f* that is close to the fifth inner surface 52*e*. When viewed in the axial direction, the second surface 66*b* extends between the first intersection point Q1 and the third bearing accommodation recess 37. The second extended surface 66 includes a third surface 66*c*, which connects the first surface 66*a* and the second surface 66*b* to each other. When viewed in the axial direction, the third surface 66*c* is a curved surface that is recessed to be separated away from the second recess 52. The internal space of the second relief recess 65 is continuous with the internal space of the second recess 52.

The third surface 66*c* is located closer to the imaginary plane S than the first intersection point Q1. A section of the third surface 66*c* that is closest to the imaginary plane S is in contact with the imaginary plane S. Thus, a section of the open edge of the second relief recess 65 that is closest to the imaginary plane S is in contact with the imaginary plane S. The second extended surface 66 includes a section of the second relief recess 65 that is closest to the imaginary plane S. The second extended surface 66 overlaps with the imaginary plane S. The second extended surface 66 may be located on the side of the imaginary plane S on which the first intersection point Q1 is located.

The second upright surface 67 intersects with the first surface 66*a*, the second surface 66*b*, and the third surface 66*c* at the edge on the side opposite from the open edge of the second relief recess 65. The second upright surface 67 is continuous with the sixth inner surface 52*f* of the second recess 52. The second upright surface 67 is opposed to the first intersection point Q1. Thus, the opening of the second relief recess 65 is opposed to at least the first intersection point Q1 and is arranged in a region on the side of the imaginary plane S on which the first intersection point Q1 is located.

When viewed in the axial direction, the entire first surface 66*a* is separated from the second bearing accommodation recess 32 and is located closer to the first intersection point Q1 than the second bearing accommodation recess 32. When viewed in the axial direction, the entire second surface 66*b* is separated from the third bearing accommodation recess 37 and is located closer to the first intersection point Q1 than the third bearing accommodation recess 37.

When viewed in the axial direction, the first surface 62*a* and the first surface 66*a* overlap with each other. When viewed in the axial direction, the second surface 62*b* and the second surface 66*b* overlap with each other. When viewed in the axial direction, the third surface 62*c* and the third surface 66*c* overlap with each other.

As shown in FIGS. 8 and 9, the second relief recess 65 extends along the axial line L1 from the second defining surface 14*e* to a point close to the first end of the second hole 54*a* and a point close the first end of the third hole 55*a*.

The operation of the present embodiment will now be described.

When the motor-driven Roots pump 10 is operating, the drive gear 18 and the driven gear 19 scoop the oil in the gear chamber 24. This causes the oil to flow into the first recess 51 and the second recess 52. Specifically, when the drive gear 18 and the driven gear 19 rotate, the oil sealed in the gear chamber 24 is scooped toward the discharge port 46 of the gear chamber 24 through the clearance between the drive gear 18 and the connecting surface 133*c* and the clearance between the driven gear 19 and the connecting surface 134*c*. The oil scooped by the drive gear 18 and the oil scooped by the driven gear 19 collide with each other in the gear chamber 24 on the side of the meshing portion 47 on which the discharge port 46 is located, and then flow into the first recess 51 and the second recess 52.

At this time, the fourth inner surface 51*d* of the first recess 51 is located closer to the meshing portion 47 than the second inner surface 52*b* of the second recess 52, and the fourth inner surface 52*d* of the second recess 52 is located closer to the meshing portion 47 than the second inner surface 51*b* of the first recess 51. Thus, the fourth inner surface 51*d* and the fourth inner surface 52*d* receive the oil that has sloshed due to collision on the side of the meshing portion 47 on which the discharge port 46 is located. This promotes the flow of oil in the axial direction in the first recess 51 and the second recess 52. Accordingly, oil is readily retained in the first recess 51 and the second recess 52.

In FIG. 6, a liquid level L10 of the oil in the gear chamber 24 when the motor-driven Roots pump 10 is operating is represented by the solid line, and a liquid level L10 of the oil in the gear chamber 24 when the motor-driven Roots pump 10 is not operating is represented by the long dashed double-short dashed line. It is now assumed that the gear chamber 24 stores an amount of oil that reaches the axial lines L1, L2, for example, as indicated by the liquid level L10 of the long dashed double-short dashed line. Even in this case, since the oil in the gear chamber 24 flows into the first recess 51 and the second recess 52 when the motor-driven Roots pump 10 is operating, the liquid level L10 of the oil in the gear chamber 24 is lowered to the position indicated by the solid line in FIG. 6. This reduces the stirring resistance of the drive gear 18 and the driven gear 19.

The oil that has flowed into the first recess 51 is supplied to the first seal accommodation recess 29 through the first oil supply passage 53. The oil that has flowed into the second recess 52 is supplied to the second seal accommodation recess 34 and the third seal accommodation recess 39 through the second oil supply passage 54 and the third oil supply passage 55. At this time, at least a part of the opening of the first recess 51 is opposed to the opening of the second recess 52 with the region between the drive gear 18 and the driven gear 19 in between. This allows oil to be evenly distributed to the first recess 51 and the second recess 52 from the gear chamber 24.

Further, the lowest section 51*g* of the first recess 51 and the lowest section 52*g* of the second recess 52 are at the same distance from the imaginary plane S. That is, the shortest distance from the first recess 51 to the imaginary plane S is equal to the shortest distance from the second recess 52 to the imaginary plane S. This allows oil to be evenly distributed to the first recess 51 and the second recess 52 from the gear chamber 24. Thus, oil is steadily supplied to the first seal member 28, the second seal member 33, and the third seal member 38, which are respectively accommodated in the first seal accommodation recess 29, the second seal accommodation recess 34, and the third seal accommodation recess 39.

The first groove 53*b* of the first oil supply passage 53 is provided in the first stepped surface 27*a* of the first bearing accommodation recess 27. Thus, the oil that flows out from inside the first recess 51 and through the first hole 53*a* and the first groove 53*b* with gravity is also supplied into the first bearing accommodation recess 27. Accordingly, oil is steadily supplied to the first bearing 26. The second groove 54*b* of the second oil supply passage 54 is provided in the second stepped surface 32*a* of the second bearing accommodation recess 32. Thus, the oil that flows out from inside the second recess 52 and through the second hole 54*a* and the second groove 54*b* with gravity is also supplied into the second bearing accommodation recess 32. Accordingly, oil is steadily supplied to the second bearing 31. The third groove 55*b* of the third oil supply passage 55 is provided in the third stepped surface 37*a* of the third bearing accommodation recess 37. Thus, the oil that flows out from inside the second recess 52 and through the third hole 55*a* and the third groove 55*b* with gravity is also supplied into the third bearing accommodation recess 37. Accordingly, oil is steadily supplied to the third bearing 36.

Under a low-temperature environment, for example, when the outside temperature is below zero Celsius, the temperature of the oil sealed in the gear chamber 24 is relatively low. When the motor-driven Roots pump 10 is activated, the drive gear 18 and the driven gear 19 rotate while scooping high-viscosity oil. Oil scooped by the drive gear 18 and oil scooped by the driven gear 19 vigorously collide with each other at the first intersection point Q1.

Some of the oil that has undergone collision at the first intersection point Q1 flows into the first relief recess 61 and the second relief recess 65. This reduces the amount of oil that is caught between the drive gear 18 and the driven gear 19. Thus, when the motor-driven Roots pump 10 is activated under a low-temperature environment, the drive gear 18 and the driven gear 19 are rotated smoothly.

The above described embodiment has the following advantages.

(1) Some of the oil that has undergone collision at the first intersection point Q1 flows into the first relief recess 61 and the second relief recess 65. This reduces the amount of oil caught between the drive gear 18 and the driven gear 19. It is thus possible to reduce the amount of high-viscosity oil that is caught between the drive gear 18 and the driven gear 19 when the motor-driven Roots pump 10 is activated under a low-temperature environment.

The relief recesses 61, 65 are located on the side of the imaginary plane S on which the first intersection point Q1 is located, that is, in the region above the axial lines L1, L2. In a comparative example, the openings of the relief recesses 61, 65 expand to positions below the axial lines L1, L2. In this comparative example, the opening of the relief recesses 61, 65 respectively extend from positions opposed to the first intersection point Q1 of the defining surfaces 13*e*, 14*e* and beyond the imaginary plane S into the region on the side on which the second intersection point Q2 is located. The comparative example thus may allow a greater amount of oil to flow into the relief recesses 61, 65.

As compared to the comparative example, the oil caught between the drive gear 18 and the driven gear 19 is less likely to flow into the relief recesses 61, 65 in the present embodiment. This prevents the amount of oil caught between the drive gear 18 and the driven gear 19 from being excessively reduced. As a result, seizure and wear are unlikely to occur in the drive gear 18 and the driven gear 19. The present embodiment thus allows the drive gear 18 and the driven gear 19 to smoothly rotate when the motor-driven Roots pump 10 is activated under a low-temperature environment, while maintaining the durability of the drive gear 18 and the driven gear 19.

(2) The relief recesses 61, 65 open in the defining surfaces 13*e*, 14*e*, respectively. This structure allows some of the oil that has undergone collision at the first intersection point Q1 to flow into the relief recesses 61, 65. This efficiently reduces the amount of oil caught between the drive gear 18 and the driven gear 19. It is thus possible to efficiently reduce the amount of high-viscosity oil that is caught between the drive gear 18 and the driven gear 19 when the motor-driven Roots pump 10 is activated under a low-temperature environment.

(3) The open edges (the lower ends of the openings) of the relief recesses 61, 65 are in contact with the imaginary plane S. This configuration efficiently reduces the amount of oil caught between the drive gear 18 and the driven gear 19, while preventing the amount of oil caught between the drive gear 18 and the driven gear 19 from being excessively reduced.

(4) The first relief recess 61 includes the first extended surface 62, which extends along the axial line L1 from the open edge of the first relief recess 61, and the first upright surface 63, which extends in a direction orthogonal to the axial line L1 from the first extended surface 62 (in a direction away from the imaginary plane S, for example, an upward direction). The first extended surface 62 includes a section of the first relief recess 61 that is closest to the imaginary plane S. The second relief recess 65 includes the second extended surface 66, which extends along the axial line L1 from the open edge of the second relief recess 65, and the second upright surface 67, which extends in a direction orthogonal to the axial line L1 from the second extended surface 66 (in a direction away from the imaginary plane S, for example, upward). The second extended surface 66 includes a section of the second relief recess 65 that is closest to the imaginary plane S.

This structure allows some of the oil that has flowed from the first intersection point Q1 into the first relief recess 61 to flow to the first upright surface 63 along the first extended surface 62. Accordingly, the oil that has flowed into the first relief recess 61 is readily stored in the first relief recess 61. This structure also allows some of the oil that has flowed from the first intersection point Q1 into the second relief recess 65 to flow to the second upright surface 67 along the second extended surface 66. Accordingly, the oil that has flowed into the second relief recess 65 is readily stored in the second relief recess 65. Thus, the oil that has flowed into the relief recesses 61, 65 is prevented from immediately returning to the gear chamber 24 from the relief recesses 61, 65. This efficiently reduces the amount of oil caught between the drive gear 18 and the driven gear 19.

(5) The first bearing 26 accommodated in the first bearing accommodation recess 27 is separated from the first defining surface 13*e* by a distance corresponding to the length along the axial line of the circular hole 271. The length of the first relief recess 61 along the axial lines L1, L2 is equal to the length of the circular hole 271 along the axial line. With this configuration, even if a part of the first surface 62*a* overlaps with the inner circumferential surface 27*b* when viewed in the axial direction, the first bearing 26, which is accommodated in the first bearing accommodation recess 27, is prevented from being exposed in the first relief recess 61. The present embodiment thus allows the first surface 62*a* to be located as close to the first bearing accommodation recess 27 as possible, while preventing the first relief recess 61 from overlapping with the space in which the first bearing 26 is accommodated. This maximizes the opening area of the first relief recess 61 in the region on the side of the first intersection point Q1 on which the first bearing accommodation recess 27 is located.

(6) When the motor-driven Roots pump 10 is activated under a low-temperature environment, the drive gear 18 and the driven gear 19 are rotated smoothly. This reduces the consumption of power of the electric motor 22.

The above-described embodiment may be modified as follows. The above-described embodiment and the following modifications can be combined as long as the combined modifications remain technically consistent with each other.

The first upright surface 63 of the first relief recess 61 may extend in a direction diagonally intersecting with the axial lines L1, L2 from the first extended surface 62. In short, it suffices if the first upright surface 63 extends in a direction intersecting with the axial lines L1, L2 from the first extended surface 62.

The second upright surface 67 of the second relief recess 65 may extend in a direction diagonally intersecting with the axial lines L1, L2 from the second extended surface 66. In short, it suffices if the second upright surface 67 extends in a direction intersecting with the axial lines L1, L2 from the second extended surface 66.

In place of the first extended surface 62, the first relief recess 61 may include an inclined surface that is inclined to be closer to the first recess 51 as the distance from the open edge of the first relief recess 61 (the section closest to the imaginary plane S) increases.

In place of the second extended surface 66, the second relief recess 65 may include an inclined surface that is inclined to be closer to the second recess 52 as the distance from the open edge of the second relief recess 65 (the section closest to the imaginary plane S) increases.

The first surface 62*a* of the first relief recess 61 and the first surface 66*a* of the second relief recess 65 do not necessarily need to be arranged in the axial direction, but may be arranged at positions displaced from each other.

The second surface 62*b* of the first relief recess 61 and the second surface 66*b* of the second relief recess 65 do not necessarily need to be arranged in the axial direction, but may be arranged at positions displaced from each other.

The third surface 62*c* of the first relief recess 61 and the third surface 66*c* of the second relief recess 65 do not necessarily need to be arranged in the axial direction, but may be arranged at positions displaced from each other. In this case, the open edge of at least one of the relief recesses 61, 65 (the section closest to the imaginary plane S) does not necessarily need to be in contact with the imaginary plane S.

The open edges of both of the relief recesses 61, 65 do not necessarily need to in contact with the imaginary plane S.

When viewed in the axial direction, a part of the first surface 62*a* does not necessarily need to overlap with the inner circumferential surface 27*b* of the first bearing accommodation recess 27. The entire first surface 62*a* may be separated from the inner circumferential surface 27*b* and may be located closer to the first intersection point Q1 than the inner circumferential surface 27*b*.

The gear housing member 13 does not necessarily need to have the first relief recess 61, which opens in the first defining surface 13*e*. Alternatively, the rotor housing member 14 does not necessarily need to have the second relief recess 65, which is opens in the second defining surface 14*e*. In short, it suffices if the housing 11 has a relief recess that opens in at least one of the defining surfaces 13*e*, 14*e*.

The drive rotor 20 and the driven rotor 21 may have a three-lobe shape or a four-lobe shape in a cross section orthogonal to the of the axial lines L1, L2.

The drive rotor 20 and the driven rotor 21 may have helical shapes.

In the above-described embodiment, the motor-driven Roots pump 10 does not necessarily need to be used as a fuel cell hydrogen pump for supplying hydrogen to a fuel cell, but may be used for other purposes.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A motor-driven Roots pump, comprising:

a housing;

a drive shaft and a driven shaft that are rotationally supported by the housing, the drive shaft and the driven shaft having axial lines that are parallel with each other;

a drive gear that is fixed to the drive shaft;

a driven gear that is fixed to the driven shaft and meshes with the drive gear;

a drive rotor that is provided on the drive shaft;

a driven rotor that is provided on the driven shaft and meshes with the drive rotor;

an electric motor that is configured to rotate the drive shaft;

a motor chamber that is defined in the housing and accommodates the electric motor;

a gear chamber that is defined in the housing and accommodates the drive gear and the driven gear, oil being sealed in the gear chamber; and a rotor chamber that is defined in the housing and accommodates the drive rotor and the driven rotor, wherein the motor chamber, the gear chamber, and the rotor chamber are arranged in order along the axial line, the housing includes a first partition that separates the gear chamber and the motor chamber from each other in an axial direction of the drive shaft and includes a first defining surface that defines the gear chamber, a second partition that separates the gear chamber and the rotor chamber from each other in the axial direction and includes a second defining surface that defines the gear chamber, and a relief recess that opens in at least one of the first defining surface and the second defining surface, when viewed in the axial direction, an addendum circle of the drive gear and an addendum circle of the driven gear intersect with each other at a first intersection point and a second intersection point, a plane that includes both of the axial line of the drive shaft and the axial line of the driven shaft is defined as an imaginary plane, the first intersection point is located on a side of the imaginary plane on which the drive gear and the driven gear start meshing with each other, the second intersection point is located on a side of the imaginary plane on which the drive gear and the driven gear finish meshing with each other, and an opening of the relief recess is arranged in a region on a side of the imaginary plane on which the first intersection point is located.

2. The motor-driven Roots pump according to claim 1, wherein the relief recess is a first relief recess that opens in the first defining surface, and the housing further includes a second relief recess that opens in the second defining surface.

3. The motor-driven Roots pump according to claim 1, wherein an open edge of the relief recess is in contact with the imaginary plane.

4. The motor-driven Roots pump according to claim 1, wherein the relief recess includes an extended surface that extends along the axial line of the drive shaft from an open edge of the relief recess, and an upright surface that extends in a direction intersecting with the axial line of the drive shaft from the extended surface.

* * * * *